United States Patent [19]

Volkmann

[11] Patent Number: 4,459,729

[45] Date of Patent: Jul. 17, 1984

[54] ABUTMENT MEMBER FOR USE IN DRIVING STUDDED METAL FENCE POSTS

[76] Inventor: Adolf P. E. Volkmann, 425 NE. 80th Ave., Portland, Oreg. 97213

[21] Appl. No.: 514,874

[22] Filed: Jul. 18, 1983

[51] Int. Cl.[3] ..... B23P 19/04

[52] U.S. Cl. ..... 29/254; 29/275; 254/30

[58] Field of Search ..... 254/29 R, 30, 31, 132; 29/254, 255, 275; 403/344, 290

[56] References Cited

U.S. PATENT DOCUMENTS

| | | | |
|---|---|---|---|
| Re. 26,685 | 10/1969 | Broske | 29/254 |
| 1,999,174 | 4/1935 | Jackson | 254/30 |
| 3,103,343 | 9/1963 | Benchley | 254/132 |
| 3,358,352 | 12/1967 | Wilcox | 29/254 |
| 3,908,960 | 9/1975 | Bagley | 254/29 R |
| 4,040,601 | 8/1977 | Boardman | 254/30 |

FOREIGN PATENT DOCUMENTS

| | | | |
|---|---|---|---|
| 136784 | 3/1950 | Australia | 254/132 |

*Primary Examiner*—Robert C. Watson

*Attorney, Agent, or Firm*—Eugene M. Eckelman

[57] ABSTRACT

First and second body portions have inwardly facing surfaces provided with recesses and lugs capable of providing a longitudinal driving connection between the two body portions. One of the body portions has recesses for receiving wire attaching studs of a metal fence post. These body portions have a tapered configuration for receiving a wedge clamping ring, and by applying a driving member against one end of the abutment member when installed on the fence post, the latter can be driven for installation or removal from the ground.

3 Claims, 5 Drawing Figures

FIG. 1
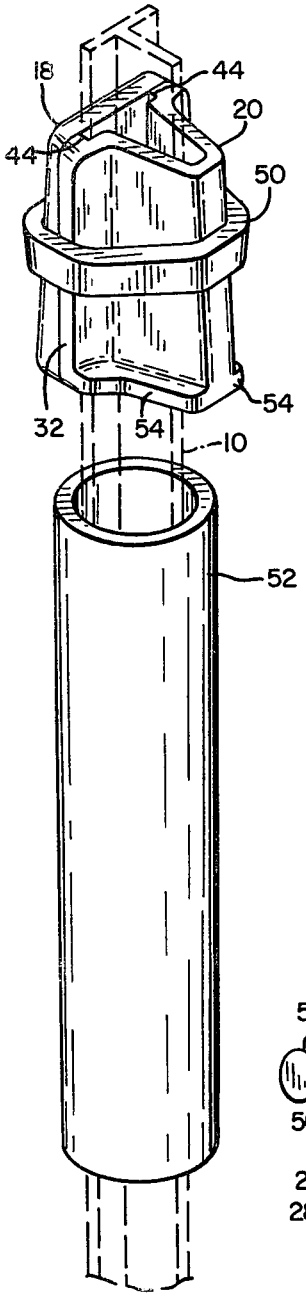
FIG. 2
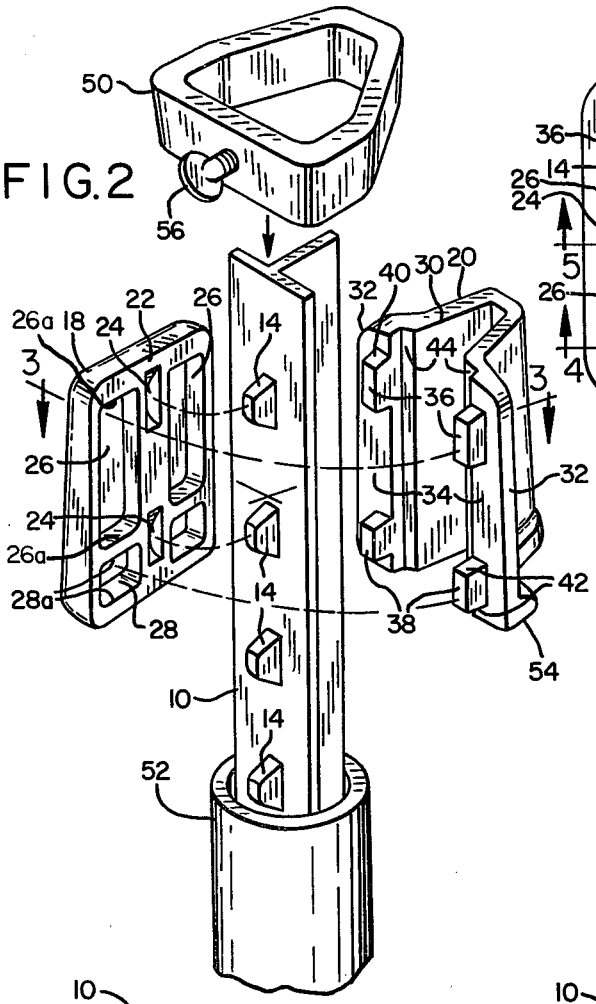
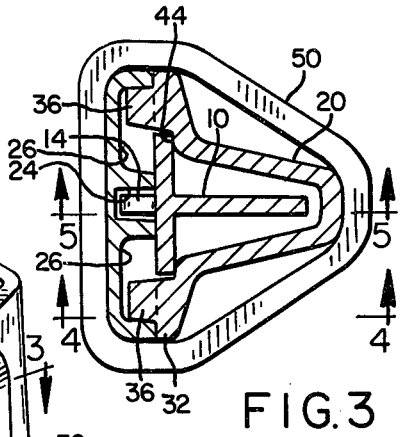
FIG. 3
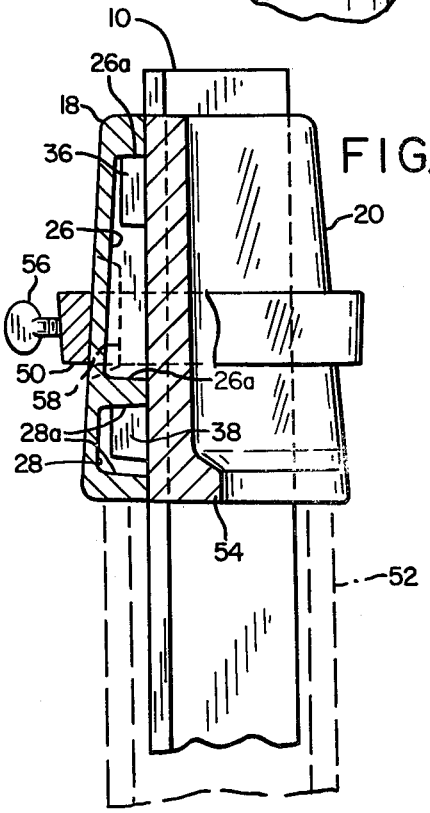
FIG. 4
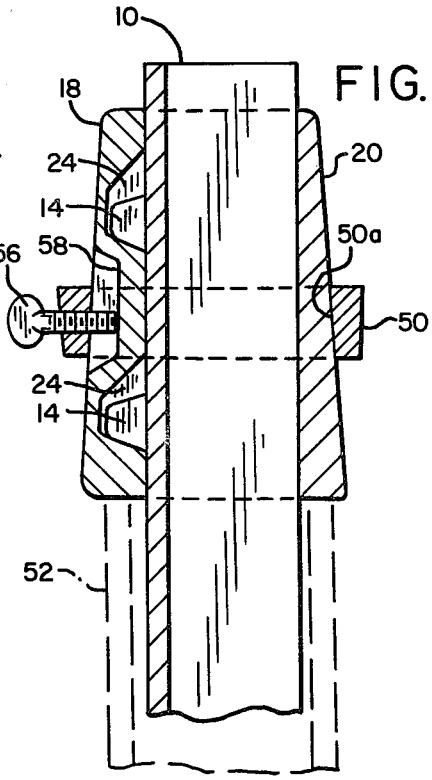
FIG. 5

ABUTMENT MEMBER FOR USE IN DRIVING STUDDED METAL FENCE POSTS

BACKGROUND OF THE INVENTION

This invention relates to a new and novel abutment member which is used in combination with a piece of pipe as a ram for installing or removing metal fence posts of the type having wire attaching studs spaced along one surface thereof.

Conventional steel fence posts employ an elongated body portion having an anchor flange adjacent the bottom and wire attaching studs on one surface of the posts in their upper wire holding portion thereof. When it is desired to install these posts in the ground, holes must be dug therefor or else they are pounded into the ground by hammering on the top edge. Providing holes therefor is time consuming and thus the posts are usually pounded into the ground. This latter method has the disadvantage that it is difficult to drive the posts straight unless two men are used. This method also damages the tops of the posts. When it is desired to remove the posts from the ground, it is necessary that they be dug out or if a powered machine is available they are pulled out. These means of removal are unsatisfactory since when they are dug out, considerable time and effort must be consumed, and when the posts are pulled out by power means, they frequently bend and are damaged to the extent that they cannot be resued.

SUMMARY OF THE INVENTION

According to the present invention and forming a primary objective thereof, an abutment member is provided which is arranged to be detachably clamped on a studded metal post and engaged by a piece of pipe for driving the post in or out. Another object is to provide a detachable abutment member of the type described which is simplified in structure, inexpensive to manufacture, and easy to use.

In carrying out the objectives of the invention, the abutment member includes first and second body portions having inwardly facing surfaces. The first body portion has recess means in its inwardly facing surface arranged to receive one or more wire holding studs of a fence post. The inwardly facing surface of the second body portion combines with the inwardly facing surface of the first body portion to form an opening from end to end of the abutment member capable of receiving a post therein. Such inwardly facing surfaces also have cooperating drive means with each other to provide a drive connection longitudinally of the abutment member. Releasable securing means are engageable with the two body portions for clamping them on a post with one or more wire holding studs of the post engaged in the recess means of the first body portion and with the drive means of the two body portions engaged with each other. One of the ends of the abutment member forms a pounding surface. The inwardly facing surfaces of the body portions are contoured to receive posts of different sizes.

The invention will be better understood and additional objects and advantages will become apparent from the following description taken in connection with the accompanying drawings.

BRIEF DESCRIPTION OF THE DRAWINGS

FIG. 1 is a perspective view of the abutment member of the invention in assembled condition and in a position for removing a post, this view also fragmentarily showing a fence post in broken lines and a piece of pipe in full lines which is used as the ram;

FIG. 2 is a perspective view of the abutment member and a fence post, the abutment member being shown disassembled and in a position to mount on a post for removing the latter;

FIG. 3 is a sectional view taken on the line 3—3 of FIG. 2 but with the parts assembled; and FIGS. 4 and 5 are sectional views taken on the lines 4—4 and 5—5 of FIG. 3, respectively.

DETAILED DESCRIPTION OF A PREFERRED EMBODIMENT

With particular reference to the drawings, the present abutment member is designed for use with steel fence posts 10. These posts generally are T-shaped and have a bottom anchor flange, not shown. In addition, these posts have equally spaced wire holding studs 14 which extend along one surface thereof, namely, along the backside of the T. FIGS. 1–5 show the abutment member installed in a manner to remove a post but as will be more apparent hereinafter, it can also be installed in a manner to install a post.

The present invention comprises a pair of body portions 18 and 20. Body portion 18 comprises a plate-like member having a flat face surface 22 provided with a pair of vertically aligned recesses 24 centrally thereof of a shape, dimension, and spacing to receive a pair of adjacent wire holding studs 14 of a fence post. Areas 26 of the metal face 22 adjacent the recesses 24 are cut out or recessed and have defining end walls **26*a*. Face surface 22 also has a pair of laterally spaced recesses 28 at the other end having defining end walls 28*a***.

The body portion 20 is U-shaped in cross section, having flared side walls 30 terminating in side flanges 32 having longitudinal flat surfaces 34. The top and bottom of the body portion 20 are open. Surfaces 34 are provided with projecting lugs 36 adjacent one end and projecting lugs 38 adjacent the other end. Lugs 36 are arranged to be received in respective cut-out portions 26 in face surface 22 when the two body portions are clamped around the post. The lugs 36 have a flat end edge 40 facing the near end of the body portion 20, these edges being engageable with edges **26*a* of the recesses 26** to provide a driving connection of the two body portions.

Lugs 38 are arranged to be received in respective recesses 28 when the body portions are clamped on a post. These lugs have a flat end edge 42 facing in the same direction as edges 40 and these latter edges are engageable with edges **28*a* of the recesses 28 to also provide a driving connection of the two body portions in conjunction with edges 40**, as will be more apparent hereinafter.

The flared configuration 30 of body portion 20 is arranged to receive the stem portion of a T-shaped fence post 10 as seen in FIG. 3, and flanges 32 have longitudinal notches 44 arranged to receive edge portions of the cross bar of the post. With the two body portions 18 and 20 installed on a post 10, the surface 22 of body portion 18 lies flat against the flanges 32 and the post is confined in the T-shaped opening formed interiorly of the two parts with the wire attaching studs 14 projecting into recesses 24. As stated, the lugs 36 and 38 of body portion 20 in such installed position project into the recesses 26 and 28, respectively, of the body portion 18 to provide a driving connection between the two body portions 18 and 20, and with the lugs 14 projecting into recesses 24, a driving connection is provided between the two body portions and the post.

With reference to FIGS. 4 and 5, the body portions 18 and 20 have an enlarging taper toward the one end, namely, toward the bottom in the drawings, and as also seen in other views of the drawings, a heavy duty ring 50 is provided to fit in wedging engagement on the exterior of the two body portions. This ring is of a shape and dimension so that it can be placed on the two body portions from the smaller end and it will have wedging engagement about half-way down on these members. The inner surface 50*a* of the ring is tapered similar to the taper of the body portions.

Ring 50 has a setscrew 56 on one side thereof arranged to engage a recess 58 in the body portion 18. This setscrew serves to hold the ring in place during pounding functions against the abutment member and also is used to hold the parts together during storage.

To use the device, the body portions 18 and 20 are placed on a post with the wire holding studs in the recesses 24 and the ring 50 placed on the exterior of the body portions. To remove fence posts a length of pipe 52 is placed on the post below the abutment member and forceful strokes of the pipe applied against the bottom end of the abutment member. This end of the abutment member comprises the pounding end and it is preferred that it be reinforced, as by a flange 54. In this upward driving force as applied by a pipe, the pipe primarily engages the bottom of body portion 20. The force of the blows is transferred from the upper edges 40 of lugs 36 and the upper edges 42 of lugs 38 to the upper recess walls 26*a* and 28*a*, respectively, in the body portion 18, FIG. 4. These latter recess portions comprise reinforced thickness walls for the purpose of withstanding the impact forces being imparted between the two body portions. A pair of wire holding studs 14 engage walls of recesses 24, FIG. 5, to transmit this force from the abutment member to the fence post. The setscrew 56 can but need not be set against body portion 20 in the process of removing a post.

For installing a post, the abutment member is assembled in the same manner as for removing a post except it is reversed vertically, namely, the flanged pounding end 54 is at the top. Pounding forces can thus be applied to drive the post down. In this operation, the setscrew must be tightened so as to maintain the ring 50 in place.

The recesses 24 may have a spacing to accommodate a slight variance in spacing of the wire attaching studs 14 so as to accommodate a spacing which may occur on different size posts 10. This may result in a driving engagement of only one recess 26 with the lugs 14 but such comprises an adequate connection. According to the invention, fence posts can be readily installed or removed by one person and in addition no damage is done to the post. When installing a post, it is easy for the person to steady the post with one hand while operating the pipe with the other hand, thus guiding the post in a vertical direction.

It is to be understood that the form of my invention herein shown and described is to be taken as a preferred example of the same and that various changes in the shape, size and arrangement of parts may be resorted to without departing from the spirit of my invention, or the scope of the subjoined claims.

Having thus described my invention, I claim:

1. An abutment member for use in combination with a driving member for driving metal fence posts of the type having equally spaced projecting wire holding studs along one surface thereof, said member comprising first and second body portions having upper and lower ends and side portions, said first and second body portions having inwardly facing surfaces, said first body portion comprising a flat plate-like portion and said second body portion being contoured to substantially the shape of a fence post, recess means in the inwardly facing surface of said first body portion arranged to receive a wire holding stud of a fence post therein in a longitudinal driving engagement, the inwardly facing surfaces of said first and second body portions being contoured to form a longitudinal opening capable of receiving a studded post therein, said inwardly facing surfaces also having cooperating drive means with each other to provide a drive engagement from end to end for said first and second body portions, and a ring having releasable wedging engagement with said first and second body portions for clamping said first and second body portions on a post with one or more wire holding studs engaged in said recess means and said drive means in said first and second body portions engaged with each other, at least one of said upper and lower ends of said side portions forming a driver engaging surface.

2. An abutment member for use in combination with a driving member for driving metal fence posts of the type having equally spaced projecting wire holding studs along one surface thereof, said member comprising first and second body portions having upper and lower ends and side portions, said first and second body portions having inwardly facing surfaces, recess means in the inwardly facing surface of said first body portion arranged to receive a wire holding stud of a fence post therein in a longitudinal driving engagement, the inwardly facing surfaces of said first and second body portions being contoured to form a longitudinal opening capable of receiving a studded post therein, said inwardly facing surfaces also having cooperating drive means with each other to provide a drive engagement from end to end for said first and second body portions, said first and second body portions when assembled having an enlarging taper toward the bottom, and a ring having releasable wedging engagement with said first and second body portions for clamping said first and second body portions on a post with one or more wire holding studs engaged in said recess means and said drive means in said first and second body portions engaged with each other, at least one of said upper and lower ends of said side portions forming a driver engaging surface.

3. The abutment member of claim 2 including a set screw in said ring engageable with one of said body portions for holding said ring in place.

* * * * *